United States Patent [19]

Konrath

[11] Patent Number: 4,718,385

[45] Date of Patent: Jan. 12, 1988

[54] FUEL INJECTION PUMP FOR INTERNAL COMBUSTION ENGINES WITH EXHAUST GAS RECIRCULATION

[75] Inventor: Karl Konrath, Freiberg, Fed. Rep. of Germany

[73] Assignee: Robert Bosch GmbH, Stuttgart, Fed. Rep. of Germany

[21] Appl. No.: 11,660

[22] Filed: Feb. 5, 1987

[30] Foreign Application Priority Data

Apr. 10, 1986 [DE] Fed. Rep. of Germany ..... 3612068

[51] Int. Cl.[4] ..... F02M 39/00

[52] U.S. Cl. ..... 123/449; 123/569; 123/503

[58] Field of Search ..... 123/449, 503, 506, 373, 123/569, 571

[56] References Cited

U.S. PATENT DOCUMENTS

| | | | |
|---|---|---|---|
| 3,942,914 | 3/1976 | Hofer | 123/449 |
| 4,286,567 | 9/1981 | Ueda | 123/569 |
| 4,411,242 | 10/1983 | Igashira | 123/571 |
| 4,452,217 | 6/1984 | Kawamura | 123/569 |
| 4,495,929 | 1/1985 | Maeda | 123/571 |
| 4,522,181 | 6/1985 | Greiwer | 123/569 |
| 4,537,170 | 8/1985 | Namada | 123/449 |
| 4,548,184 | 10/1985 | Laufer | 123/569 |
| 4,635,605 | 1/1987 | Faupel | 123/503 |

FOREIGN PATENT DOCUMENTS

| | | | |
|---|---|---|---|
| 2448693 | 4/1976 | Fed. Rep. of Germany | 123/449 |
| 3013087 | 10/1981 | Fed. Rep. of Germany | 123/449 |
| 3203582 | 8/1983 | Fed. Rep. of Germany | 123/449 |
| 0105616 | 8/1979 | Japan | 123/503 |
| 0000545 | 1/1981 | Japan | 123/449 |

*Primary Examiner*—Carl Stuart Miller
*Attorney, Agent, or Firm*—Edwin E. Greigg

[57] ABSTRACT

A fuel injection pump for internal combustion engines, of the distributor type, having a reciprocating and simultaneously rotating pump piston as well as a governor slide adjustable relative thereto as a function of load, the injection quantity at any time being dimensioned on the basis of the position of the governor slide. For controlling an exhaust gas recirculation valve as a function of the load range or the particular injection quantity, the injection pump has a pressure switch for controlling an electrical signal in the partial-load range. The pressure switch can be made to communicate with the pressure-carrying suction chamber via a line in the housing and a conduit in the pump piston, the inlet of which conduit is controlled by the governor slide such that it is opened only whenever the outlet of a relief conduit is closed by the governor slide.

22 Claims, 1 Drawing Figure

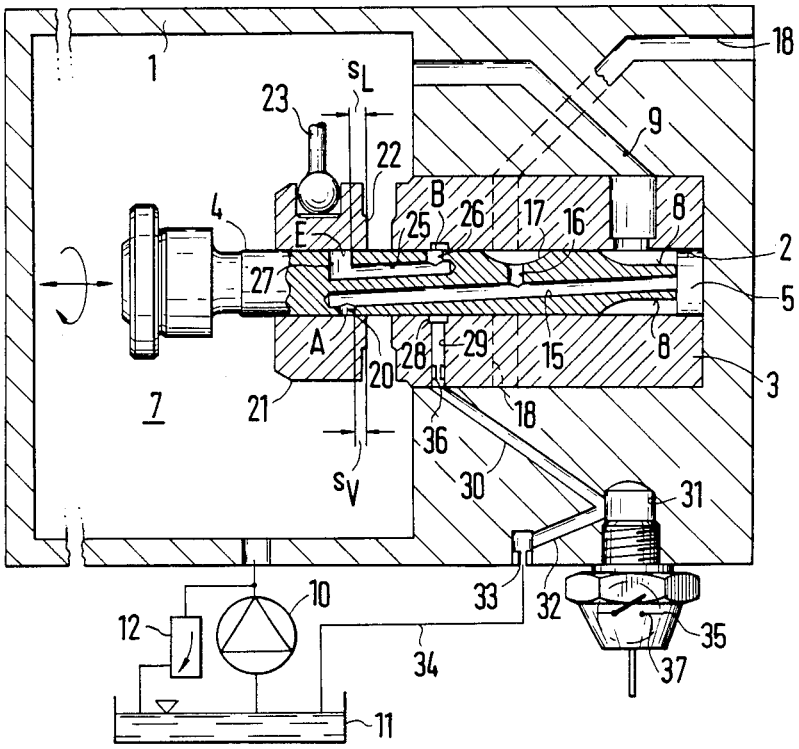
1
18
23
$s_L$
22
9
B
26
17
16
8
4
E
25
2
27
5
A
28
29
15
8
20
3
7
21
18
36
30
31
$s_V$
33
32
10
12
35
34
37
11

FUEL INJECTION PUMP FOR INTERNAL COMBUSTION ENGINES WITH EXHAUST GAS RECIRCULATION

BACKGROUND OF THE INVENTION

The invention is based on a fuel injection pump for internal combustion engines with exhaust gas recirculation. In this kind of injection pump, known for example from U.S. Pat. 4,452,217, a sensor associated with the rpm adjusting lever generates an electrical signal as a function of the rpm adjusting lever position, and based on this signal an exhaust gas recirculation valve is controlled such that it is opened in the partial-load range of the engine and closed in the full-load range. The association of the sensor with the adjusting lever affecting the engine rpm represents a compromise, because the variable position of the adjusting lever does not directly correspond to a particular engine load range. Yet to reduce exhaust emissions, it is essential that the exhaust gas recirculation valve be controlled directly in accordance with the actual operating load range of the engine.

OBJECT AND SUMMARY OF THE INVENTION

The fuel injection pump according to the invention as defined hereinafter has the advantage over the prior art in which that the basis for controlling the exhaust gas recirculation valve is the position of the governor slide, which is directly definitive for the metering of the required injection quantity for a particular load status and is the standard for the operating state of the engine. A further advantage is that except for fixing the spacing of the outlet of the relief conduit from the inlet of the other conduit in the pump piston, no other operations for setting or associating elements with one another have to be made. Another advantage is that the rpm-dependent feed pressure of a feed pump, which also prevails in the injection pump suction chamber which receives the governor slide, is used for converting the position of the governor slide into an electrical signal.

Among other advantageous features of the invention, a simple opportunity is provided of disposing the control element at a favorable location of the pump housing, depending on the requirements.

The invention will be better understood and further objects and advantages thereof will become more apparent from the ensuing detailed description of a preferred embodiment taken in conjunction with the drawing.

BRIEF DESCRIPTION OF THE DRAWINGS

The single drawing FIGURE is a longitudinal section taken through a fuel injection pump made according to the invention.

DESCRIPTION OF THE PREFERRED EMBODIMENT

Recirculation of exhaust gas to the intake tube of an internal combustion engine has proved to be an effective means of reducing the proportion of toxic components in the exhaust gases of internal combustion engines. In self-igniting engines in particular, the high proportion of $NO_x$ can be reduced. These freely aspirating engines, guided by means of the fuel injection quantity, are operated in the partial-load range with a considerable air excess, which can be reduced by the admixture of recirculated exhaust gas. As a result, combustion is affected such that the toxic $NO_x$ content is reduced.

A pump cylinder liner 3 is inserted into a housing 1 of a fuel injection pump, and in its cylinder 2 within cylinder liner 3, a pump piston 4 is displaceable, being set for simultaneous reciprocating and rotary motion by a drive mechanism, not shown, as shown by the arrows. With its end face within the cylinder liner 3, the pump piston 4 encloses a pump work chamber 5 within the housing 1, and with its other end it protrudes out of the cylinder liner 3 into a suction chamber 7 of the housing 1. On this outer end, the pump piston 4 is connected to the drive mechanism, not shown in detail. The pump work chamber 5 is supplied with fuel from the pump suction chamber 7, via longitudinal grooves 8 disposed in the jacket face of the pump piston 4 and via an intake bore 9 extending through the cylinder liner 3 and housing 1, as long as the pump piston 4 is executing its intake stroke or assumes its bottom dead center position shown in the drawing. A feed pump 10 pumps fuel, at a pressure that increases with the rpm, from a fuel supply container 11 into the suction chamber 7 of the housing. A pressure control valve 12 connected parallel to the feed pump 10 controls the pressure in the pump suction chamber 7 in accordance with rpm in a known manner.

A relief conduit 15, embodied as a blind bore, is disposed in the pump piston 4, and is open toward the work chamber 5. Branching off from this relief conduit 5 is a radial bore 16, which leads to a larger distributor groove 17 in the jacket face of the pump piston 4. A plurality of feed lines 18 branch off in a radial plane of the cylinder 2, in the area of the piston where the distributor groove 17 revolves with the piston as the piston rotates. These feed lines being distributed uniformly about the circumference of the cylinder 2 and agreeing in number with the number of cylinders of the associated engine that are to be supplied. The feed lines 18 lead to the fuel injection locations of the cylinders of the engine, not shown.

In the vicinity of the portion of the pump piston 4 that protrudes into the suction chamber 7, a radial bore 20 branches off from the relief conduit 15, forming an outlet A in the jacket face of the pump piston 4. In the vicinity of the outlet A, an annular governor slide 21, as a quantity adjusting device, is disposed in a displaceable manner on the pump piston 4. The end face of the governor slide oriented toward the cylinder liner 3 forms a control edge 22 for opening and closing the outlet A. The governor slide 21 is adjusted axially relative to the pump piston 4 by a governor device, not shown, via a governor lever 23, in accordance with a plurality of operating parameters such as desired rpm, air pressure, temperature and the like. On being so adjusted, when the fuel injection quantity is large the governor slide 21 assumes a position shown in the drawing, in which in the bottom dead center position of the pump piston 4 the spacing between the outlet A of the relief conduit 15 and the control edge 22 of the governor slide 21 has the dimension $s_v$. For feeding lesser injection quantities, in the partial-load range, the governor slide 21 is adjusted toward the left as seen in the drawing, so that the spacing between the outlet A and the control edge 22 becomes shorter. As a result, the available useful stroke at any time, which the pump piston 4 or more specifically the outlet A must execute from the bottom dead center of the pump piston 4 is changed. The position of the control edge 22 of the governor slide 21 is therefore definitive for the size of the injection quantity at any time in a predetermined load range of the engine.

A second axially extending conduit 25 is also disposed in the pump piston 4, and branching off from this conduit, in the vicinity of the pump piston portion that is always located in the cylinder 2, are a radial bore 26 having an outlet B and, in the operative vicinity of the governor slide 21, a radial bore 27 having an inlet E. In the bottom dead center position of the pump piston 4 and when the governor slide 21 is in the full-load position (the position shown in the drawing), the inlet E of the conduit 26 is spaced apart by a distance $s_L$ from the control edge 22 of the governor slide 21; this distance is greater than the distance $s_v$ between the outlet A of the relief conduit 15 and the control edge 22, so that the inlet E of the conduit 25 is offset by a predetermined distance with respect to the outlet A of the relief conduit 15. Because of this arrangement, it is attained that when the pump piston 4 executes a stroke the conduit 25 is not opened until after the outlet A of the relief bore 15 has already been uncovered. As a result, in full-load operation, when the governor slide 21 is shifted into its extreme right-hand position (as seen in the drawing), the inlet E of the conduit 26 is not opened at all during the compression stroke of the pump piston 4. Contrarily, the inlet E is uncovered by the governor slide 21 toward the end of the compression stroke of the pump piston 4, whenever the governor slide assumes a position, in partial-load operation, that is to the left, as seen in the drawing, of the position shown in the drawing and in which during the pump piston stroke the outlet A of the relief bore 15 has already been uncovered whenever the inlet E of the conduit 25 reaches the control edge 22 of the governor slide 21.

In the vicinity of the outlet B of the conduit 25, an annular groove 28 is disposed in the cylinder liner 3, communicating via a radial bore 29 in the cylinder liner 3 and via a bore 30 with a blind bore 31 in the housing. Branching off from the blind bore 31 is a bore 32 leading to an outflow throttle 33, from which a line 34 leads to the pressure-free fuel supply container 11.

A pressure switch 35, known per se, is screwed into the blind bore 31, and at a pressure on the order of the feed pressure prevailing in the suction chamber 7 this switch closes an electrical contact 37 and thus completes an electrical circuit to produce an electrical signal for controlling an exhaust gas recirculation valve of the engine. The subjection of the pressure switch 35 to fuel from the suction chamber 7 and to the pressure prevailing there is controlled as a function of the position of the governor slide 21. As noted above, the inlet of the conduit 25, which communicates via the annular groove 28 and the bores 29 and 30 with the pressure switch 35, is not opened in the full-load position of the governor slide 21 during the remaining stroke of the pump piston 4 following the opening of the outlet A, so that the blind bore 31, which is pressure-relieved via the outflow throttle 33, and hence the pressure switch 35 are pressure-free. Contrarily, at a position of the governor slide 21 in the partial-load range, the inlet E of the conduit 25 is uncovered toward the end of the compression stroke of the pump piston 4, so that the fuel pressure in the suction chamber 7 can flow through the inlet E, conduit 25 and the bores 29, 30, to act upon the pressure switch 35. When pressure is imposed on the switch 35, the contact 37 of the pressure switch 35 is closed, so that an electrical circuit for an electrical control signal is completed which signal can be used directly for opening the engine exhaust gas recirculation valve, or serves as a control signal as one of the engine operating parameters.

To prevent an overly strong pressure pulsation from affecting the pressure switch 35, a throttle 36 can be disposed in the radial bore 29 in the cylinder liner 3.

It is also noted that to generate an electrical signal proportional to the rpm and/or the load, instead of the pressure switch a pressure-sensitive sensor element can be provided, which emits a proportional electrical signal as a function of the control pressure.

It is further noted that the control element for emitting an electrical signal for controlling an exhaust gas recirculation valve is shown, in the exemplary embodiment described above, in connection with an injection pump in which the particular injection quantity in the various load ranges is dimensioned by means of the governor slide 21, by interrupting the supply of the injection quantity at an earlier or later point prior to top dead center of the pump piston 4. However, the described apparatus for generating an electrical signal can also be provided with injection pumps of the kind in which, in a manner known per se, the beginning of supply by the pump piston is performed following an idle stroke, of greater or lesser length, of the pump piston. In this kind of embodiment, the inlet of the conduit leading to the control element should be disposed on the pump piston in such a way that it is opened only whenever the outlet of the relief conduit is open.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines with exhaust gas recirculation, having an electrical control element, actuated in accordance with load, for completing or controlling an electrical circuit for controlling an exhaust gas recirculation valve, which comprises a housing, a fuel suction chamber (7) in said housing, a cylinder (2) formed in said housing, a pump piston (4) driven such that said pump piston simultaneously reciprocates and rotates in said cylinder (2), a pump work chamber (5) formed in said cylinder between one end of said pump piston and said housing, a relief conduit (15) extending axially within said pump piston from said work chamber and having a blind bore and communicating permanently with the pump work chamber and outlet from said relief conduit juxtaposed said blind bore, a governor slide (21) that surrounds the pump piston in said suction chamber (7) subjected to fuel pressure and adjustable in accordance with load, said governor slide adapted to close said outlet (A) of the relief conduit during a variable portion of a stroke course of said pump piston, a second conduit (25) disposed in said pump piston (4), said second conduit including an inlet (E) and an outlet (B with its inlet (E) disposed in an operative range of the governor slide (21) spaced apart from the outlet (A) of the relief conduit (15), such that the inlet (E) of the conduit (25) is opened only whenever the outlet of the relief conduit is open, a line (29, 30) in said housing that communicates with said outlet (B) that leads to a blind bore (31), a control element (35) that communicates with said blind bore (31), said control element operated by a pressure force and a relief line (32, 33) that connects with said blind bore (31).

2. A fuel injection pump as defined by claim 1, in which said inlet (E) of said conduit (25) is spaced apart axially from said outlet (A) of said relief conduit (15) by a distance which is greater than a remaining portion of a stroke of said pump piston (4) following an opening of said outlet (A) by the governor slide (21) in its full-load position.

3. A fuel injection pump as defined by claim 1, in which said relief line includes an outflow throttle (33) that communicates with a connection point of said control element (35).

4. A fuel injection pump as defined by claim 2, in which said relief line includes an outflow throttle (33) that communicates with a connection point of said control element (35).

5. A fuel injection pump as defined by claim 3, in which a second throttle (36) is disposed in the line (29, 30) leading to the control element (35).

6. A fuel injection pump as defined by claim 4, in which a second throttle (36) is disposed in the line (29, 30) leading to the control element (35).

7. A fuel injection pump as defined by claim 1, in which said control element (35) is an electric switch (37).

8. A fuel injection pump as defined by claim 2, in which said control element (35) is an electric switch (37).

9. A fuel injection pump as defined by claim 3, in which said control element (35) is an electric switch (37).

10. A fuel injection pump as defined by claim 5, in which said control element (35) is an electric switch (37).

11. A fuel injection pump as defined by claim 1, in which said control element is a pressure sensor, which emits an electrical signal that is proportional to the prevailing pressure.

12. A fuel injection pump as defined by claim 2, in which said control element is a pressure sensor, which emits an electrical signal that is proportional to the prevailing pressure.

13. A fuel injection pump as defined by claim 3, in which said control element is a pressure sensor, which emits an electrical signal that is proportional to the prevailing pressure.

14. A fuel injection pump as defined by claim 5, in which said control element is a pressure sensor, which emits an electrical signal that is proportional to the prevailing pressure.

15. A fuel injection pump as defined by claim 7, in which said control element is a pressure sensor, which emits an electrical signal that is proportional to the prevailing pressure.

16. A fuel injection pump as defined in claim 1, in which said control element (35) is mounted on the housing (1) of the injection pump and communicates through lines (25, 29, and 30) therein with the suction chamber (7) when the governor slide (21) has uncovered inlet (E) to said second conduit (25).

17. A fuel injection pump as defined in claim 2, in which said control element (35) is mounted on the housing (1) of the injection pump and communicates through lines (25, 29, and 30) therein with the suction chamber (7) when the governor slide (21) has uncovered inlet (E) to said second conduit (25).

18. A fuel injection pump as defined by claim 3, in which said control element (35) is mounted on the housing (1) of the injection pump and communicates through lines (25, 29, and 30) therein with the suction chamber (7) when the governor slide (21) has uncovered inlet (E) to said second conduit (25).

19. A fuel injection pump as defined by claim 5, in which said control element (35) is mounted on the housing (1) of the injection pump and communicates through lines (25, 29, and 30) therein with the suction chamber (7) when the governor slide (21) has uncovered inlet (E) to said second conduit (25).

20. A fuel injection pump as defined by claim 7, in which said control element (35) is mounted on the housing (1) of the injection pump and communicates through lines (25, 29, and 30) therein with the suction chamber (7) when the governor slide (21) has uncovered inlet (E) to said second conduit (25).

21. A fuel injection pump as defined by claim 11, in which said control element (35) is mounted on the housing (1) of the injection pump and communicates through lines (25, 29, and 30) therein with the suction chamber (7) when the governor slide (21) has uncovered inlet (E) to said second conduit (25).

22. A fuel injection pump as defined in claim 1, in which said cylinder (2) is formed in a pump cylinder liner fixed in said housing.

* * * * *